United States Patent [19]

Bulman

[11] Patent Number: 4,934,242

[45] Date of Patent: Jun. 19, 1990

[54] LIQUID PROPELLANT GUN FOR PROJECTILES OF DIFFERENT MASSES AND VELOCITIES

[75] Inventor: Melvin J. Bulman, Folsom, Calif.

[73] Assignee: General Electric Company, Pittsfield, Mass.

[21] Appl. No.: 300,639

[22] Filed: Dec. 18, 1988

[51] Int. Cl.[5] ..... F41F 1/04; F42B 5/16

[52] U.S. Cl. ..... 89/7; 102/440

[58] Field of Search ..... 89/7; 102/440

[56] References Cited

U.S. PATENT DOCUMENTS

| | | | |
|---|---|---|---|
| 4,291,627 | 9/1981 | Ziemba et al. | 102/265 |
| 4,341,147 | 7/1982 | Mayer | 89/7 |
| 4,523,508 | 6/1985 | Mayer et al. | 89/7 |
| 4,586,422 | 5/1986 | Magoon | 89/7 |
| 4,603,615 | 8/1986 | Ashley | 89/7 |
| 4,693,165 | 9/1987 | Magoon et al. | 89/7 |
| 4,711,153 | 12/1987 | Bulman | 89/7 |
| 4,763,577 | 8/1988 | Romer et al. | 102/431 |
| 4,768,441 | 9/1988 | Theis | 102/517 |

*Primary Examiner*—David H. Brown

*Attorney, Agent, or Firm*—Bailin L. Kuch

[57] ABSTRACT

A gun is provided having a housing, a main gun barrel, a combustion chamber, a liquid propellant pumping chamber, and valve means for providing a variable orifice injection port intercoupling said pumping and combustion chambers which includes means for controlling the rate of opening of the orifice during the period of injection.

17 Claims, 2 Drawing Sheets

LIQUID PROPELLANT GUN FOR PROJECTILES OF DIFFERENT MASSES AND VELOCITIES

BACKGROUND OF THE INVENTION

1. Field of the Invention

This invention relates to a liquid propellant gun having an annular piston for regenerative injection for launching projectiles of different masses at different respective velocities.

2. Art Background of the Invention

Guns having annular pistons for regenerative injection of liquid propellant from a pumping chamber into a combustion chamber are shown in several patents, such as:

U.S. Pat. No. 4,745,841 issued to I. K. Magoon et al on May 24, 1988;

U.S. Pat. No. 4,693,165 issued to I. K. Magoon et al on Sept. 15, 1987;

U.S. Pat. No. 4,586,422 issued to I. K. Magoon et al on May 6, 1986;

U.S. Pat. No. 4,523,508 issued to R. E. Mayer et al on June 18, 1985; and

U.S. Pat. No. 4,341,147 issued to R. E. Mayer on July 27, 1982.

Each of these guns is designed to shoot a particular projectile having a respective mass at a desired respective velocity. Other guns, such as those intended to be carried by tanks, must be designed to fire a variety of projectiles, each having a different mass and desired respective velocity. The two currently popular families of projectiles are: (i) the High Explosive Anti-Tank (HEAT) projectile, and the Armor Piercing Fin Stabilized Discarding Sabot (APFSDS) projectile. These projectiles differ significantly in mass and desired muzzle velocity. The APFSDS projectile relies on its terminal kinetic energy to itself penetrate the armor of its target and, therefore, requires the maximum possible muzzle velocity. The HEAT projectile relies on a shaped charge of high explosive to generate an aperture in the armor of the target and is significantly heavier than the equivalent caliber APFSDS projectile assembly. If a gun were optimized to fire the APFSDS projectile assembly at maximum high velocity and the heavier HEAT projectile were fired, and if there were no compensation for the greater mass, then an excessive chamber pressure would be expected, which might provide catastrophic results. This would be due to the higher inertia of the heavier projectile. To enable the firing of a HEAT projectile, in a gun which will satisfactorily fire an APFSDS projectile, at the same, or if desired, a lower chamber pressure, the regenerative rate of injection of liquid propellant into the combustive chamber must be selectively reduced.

Accordingly, it is an object of this invention to provide a gun mechanism which will regeneratively inject liquid propellant into its combustion chamber at selectable different rates.

It is another object to provide a gun mechanism which will regeneratively input liquid propellant into its combustion chamber at a rate which may be selectably varied during the period of injection.

A feature of this invention is a gun having a housing, a main gun barrel, a combustion chamber, a liquid propellant pumping chamber, and valve means for providing a variable orifice injection port intercoupling said pumping and combustion chambers which includes means for controlling the rate of opening of the orifice during the period of injection.

BRIEF DESCRIPTION OF THE DRAWING

The present invention will become more fully understood from the detailed description given hereinbelow and the accompanying drawing which are given by way of illustration only, and are not limitative of the present invention and wherein.

DESCRIPTION OF THE INVENTION

Figure 1:
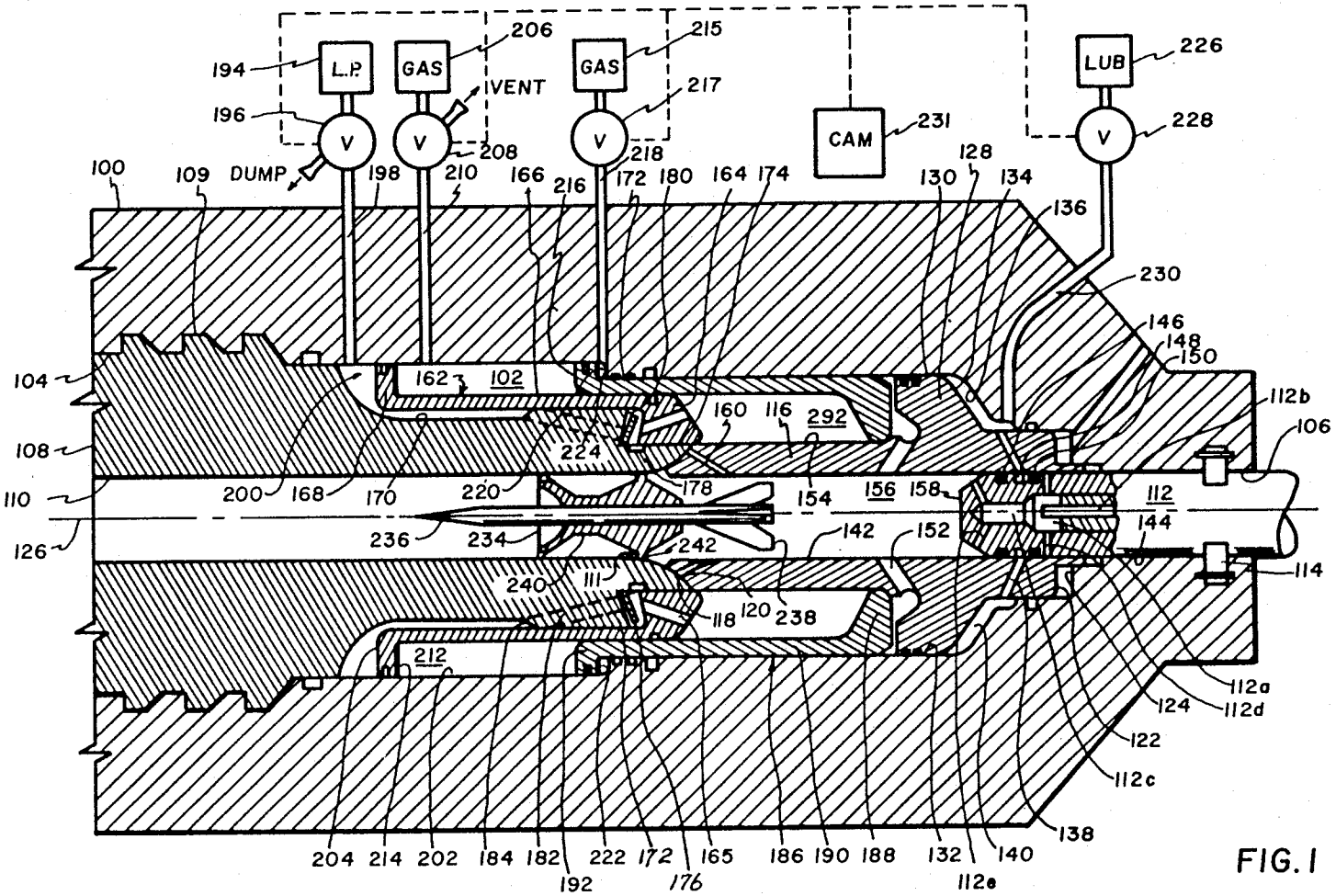
FIG. 1 is a view in elevation, in longitudinal cross section, of a first embodiment of this invention, with an APFSDS projectile without a cartridge case.

A first embodiment of this invention is shown in FIG. 1. A gun housing 100 has a central cavity 102 which has a forward opening 104 and an aft opening 106 serving as the breech. A main gun barrel 108, with conventional retention means such as interrupted threads 109, is secured into the forward opening 104 and has a longitudinal bore 110 with a forcing cone 111. A gun bolt 112 is reciprocable into and out of the aft opening 106 and is locked with conventional bolt locks 114. A short barrel 116 is disposed within the housing cavity 102 aft of the main barrel 108 and is reciprocable between a forward disposition whereat its conical-concave forward face 118 is flush against the conical-convex aft face 120 of the main barrel 108 and an aft disposition whereat its aft transverse face 122 is flush against the aft transverse face 124 of the housing cavity 102. The housing, the main barrel, the short barrel, and the gun bolt have a common longitudinal axis 126. The short barrel 116 has an annular flange 128 having an outer cylindrical surface 130 with annular seals which seal against an inner cylindrical surface 132 of the housing cavity, and an aft annular surface 134 which will mate with an inner surface 136 of the housing cavity. The short barrel 116 also has an aft plurality of bores 138, disposed in an annular row, leading from the cavity 140 defined by the surfaces 134 and 136 to the interface between the inner longitudinal bore 142 of the short barrel and the exterior annular face 144 of the gun bolt 112. This exterior face 144 has a plurality of annular grooves 146, 148, and 150 therein. The short barrel 116 also has an intermediate plurality of bores 152, disposed in an annular row leading from the exterior surface 154 of the short barrel, forward of the flange 128, through the inner longitudinal wall of the bore 142, into the combustion chamber 156 which is defined by the short barrel bore 142 and the forward transverse face 158 of the gun bolt. The short barrel 116 also has a forward plurality of bores 160 disposed in an annular row leading from the conical-concave forward face 118 through the inner longitudinal bore 142 into the combustion chamber 156.

A generally tubular fill valve 162 has an aft annular head portion 164 having a plurality of bores 165 disposed in an annular row, an intermediate annular portion 166 and a forward tail portion 168. The fill valve 162 is telescopically disposed for fore and aft reciprocation on the aft portion of the main gun barrel 108. This barrel aft portion has a reduced annular surface 170, an intermediate enlarged annular surface 172, and an aftmost further reduced annular surface 174. A belleville washer 176 is captured by a recessed C-clip 178 against an aft facing transverse surface 180 which extends between the annular surfaces 172 and 174. A plurality of bores 182 is disposed in an annular row leading from the transverse surface 180 to a forward facing transverse surface 184 which extends between the annular surfaces 172 and 170.

A generally tubular annular regenerative piston 186 has an aft annular head portion 188, an intermediate annular portion 190 and a forward tail portion 192. The piston 186 is telescopically disposed for fore and aft reciprocation on the fill valve 162 with its annular head portion 188 telescopically disposed on the exterior annular surface 154 of the short barrel 116.

A source 194 of liquid propellant under pressure and a dump outlet are coupled via a two way, cam controlled valve 196 to a conduit which is coupled to a passageway 198 through the housing 100 which opens to a propellant reservoir annular cavity 200 which is defined by the annular inner wall 202 of the housing cavity 102, the reduced annular surface 170 of the main barrel 108 and the interior annular forward transverse surface 204 of the fill valve 162.

A source 206 of gas under pressure and a vent outlet are coupled via a two way, cam controlled valve 208 to a conduit which is coupled to a passageway 210 through the housing 100 which opens to a pneumatic spring annular cavity 212 which is defined by the inner annular wall 202 of the housing cavity 102, the exterior annular aft transverse surface 214 of the fill valve 162, and the forward transverse face 216 of the piston 186. The valve 208, when coupled to the source applies gas pressure to the cavity 212, and when coupled to the vent, reduces the pressure in the cavity 212 to atmosphere. This cavity, when filled with gas under pressure, provides a forward bias on the fill valve 162 equivalent to that of a helical compression spring.

A source 215 of gas under pressure is coupled via a cam controlled valve 217 to a conduit which is coupled to a passageway 218 through the housing 100 which opens to a pneumatic spring annular cavity 220 which is defined by the inner annular wall 202 of the housing cavity 102, the exterior annular aft transverse surface 222 of the piston 186, and a transverse forward facing surface 224 in the housing cavity 102. This cavity, when filled with gas under pressure, provides a forward bias on the piston 186 equivalent to that of a helical compression spring.

A source 226 of lubricating fluid under pressure is coupled via a cam controlled, bidirectional, variable orifice valve 228, which may be within the housing, to a passageway 230 through the housing 100 which opens to the cavity 140 which serves as a lubricant pumping chamber. This pumping chamber, when filled with lubricating fluid, acts as a dash-pot and serves a two fold purpose: It provides, via the aft plurality of bores 138 leading to the interface between the gun bolt 112 and the aft portion of the longitudinal bore 142 of the short barrel, a fixed hydraulic resistance and a renewable liquid investment seal. Such seals are discussed in U.S. Pat. No. 4,050,352, issued Sept. 27, 1977, to D. P. Tassie, which is hereby incorporated by reference. It also provides, via the bidirectional, selectably variable orifice valve 228, a selectably variable hydraulic resistance to aftward movement of the short barrel. The valve 228 may be embodied as a spool valve having a spool which is cam controlled as shown in U.S. Pat. No. 3,763,739, issued Oct. 9, 1973 to D. P. Tassie, which is hereby incorporated by reference. As taught by Tassie, a drum cam 231 can be utilized to control all of the functions of the operating cycle of the gun. See also U.S. Pat. No. 4,244,270, issued Jan. 13, 1981 to D. P. Tassie.

The gun bolt 112, for use with a direct interface with liquid propellant, may be of the type shown in U.S. patent application Ser. No. 263,792, filed May 14, 1981 by M. J. Bulman which is hereby incorporated by reference. Briefly, that bolt has an ignition antechamber **112*a* which has two electrodes (the body and a central 112*b*, an inertial column 112*c* with an orifice 112*e* (here shown as two) communicating with the gun combustion chamber, and an inlet conduit 112*d*** (here shown as two) receiving a metered supply of liquid propellant, and a source (not shown) of a voltage pulse to the electrodes.

The locks 114 for the gun bolt 112 may be of the type shown in U.S. Pat. No. 3,772,959, issued Nov. 20, 1973 to D. P. Tassie.

The ammunition fired by the gun may vary in purpose, shape and weight. A kinetic energy, subcaliber, saboted projectile is shown in FIG. 1. This projectile assembly 234 may be of the type shown in U.S. Pat. No. 4,768,441, issued Sept. 6, 1988 to U. Theis. It includes a subcaliber projectile 236 having a tail stabilizer 238 and a segmented sabot 240 having an annular gas obturator 242.

Figure 2:
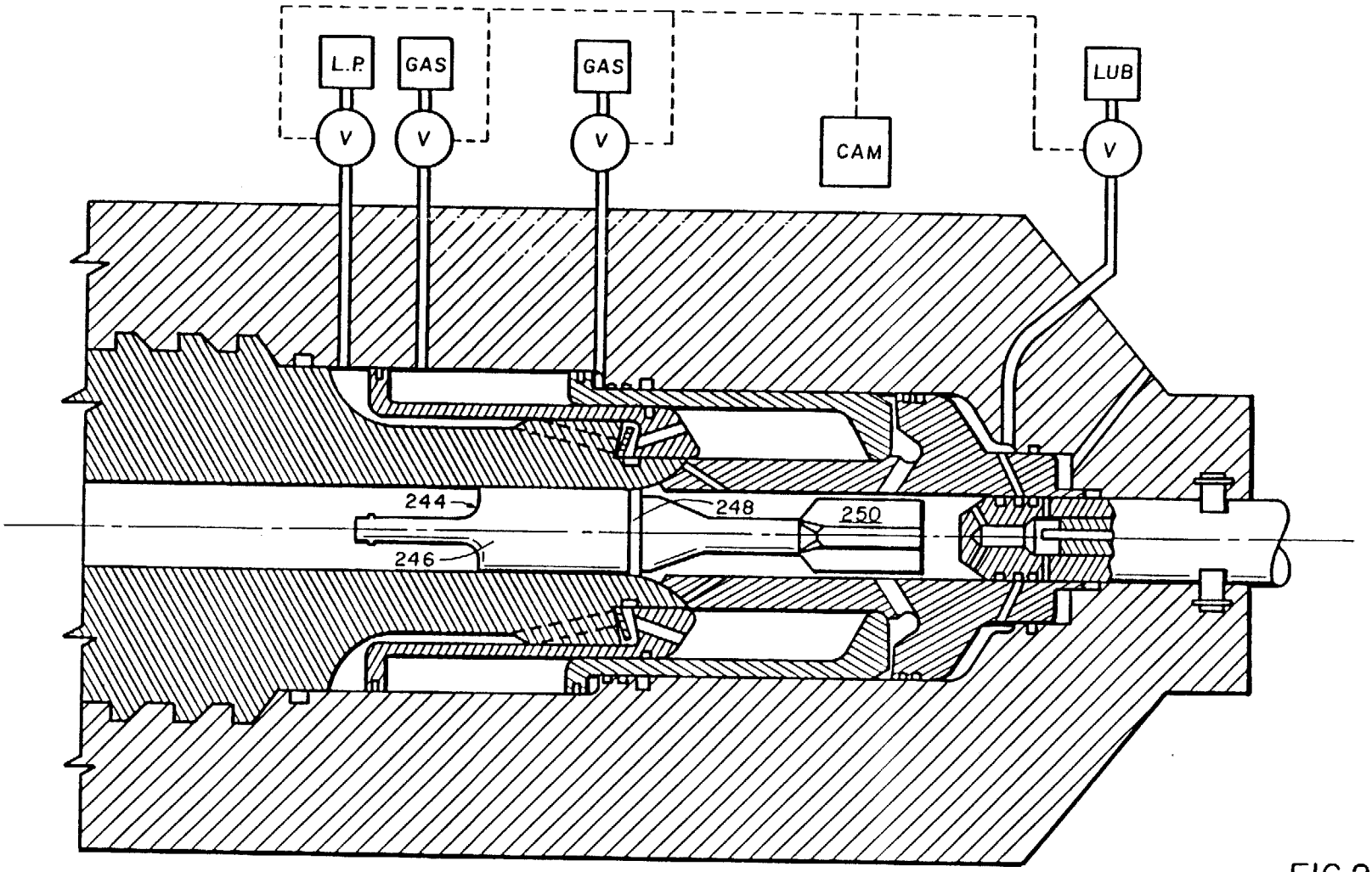
FIG. 2 is a view in elevation, in longitudinal cross section, similar to the first embodiment shown in FIG. 1, with a HEAT projectile without a cartridge case.

A high explosive anti-tank projectile is shown in FIG. 2. This projectile assembly 244 may be of the type shown in U.S. Pat. No. 4,291,627, issued Sept. 29, 1981 to R. T. Ziemba et al. It includes a housing 246 having an annular gas obturator 248 and a tail stabilizer 250.

Figure 3:
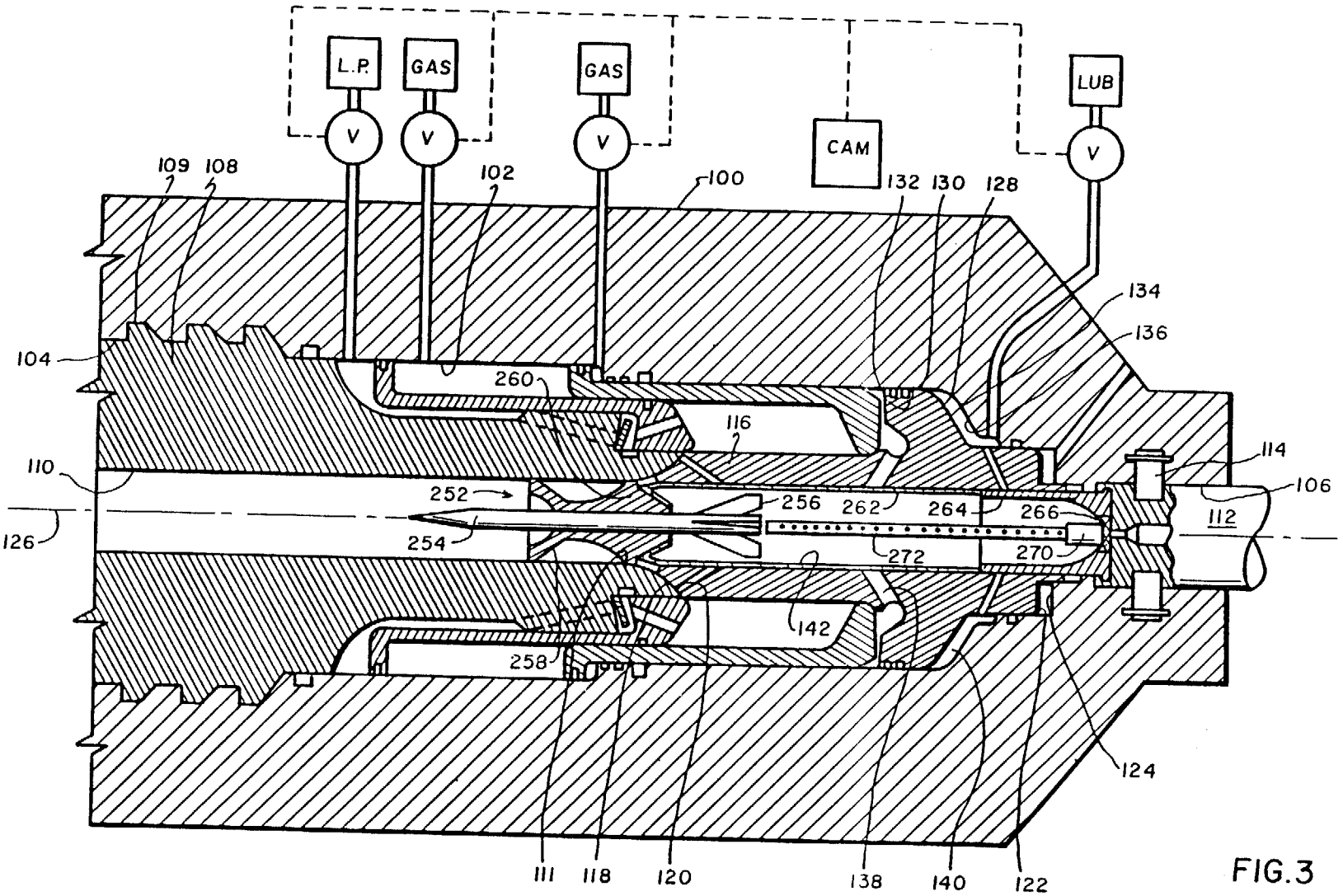
FIG. 3 is a view in elevation, in longitudinal cross section, similar to the first embodiment shown in FIG. 1, with an APFSDS projectile with a stub case.

A kinetic energy, subcaliber, saboted projectile with a stub case is shown in FIG. 3. This projectile assembly 252 may be of the type shown in U.S. Pat. No. 4,763,577, issued Aug. 16, 1988 to R. Romer et al. It includes a subcaliber projectile 254 having a tail stabilizer 256, a segmented sabot 258 having an annular gas obturator 260, a combustible case 262, and a stub case 264 having an electric primer 266, a booster charge 270, and a flash tube 272 secured to the stub case. A gun bolt having a conventional electrical firing pin is shown in lieu of the gun bolt with a liquid propellant igniter. Lubricating fluid is provided to the interface of the short barrel 116 with the stub case 264 to lubricate the rapid aftward movement of the short barrel.

Figure 4:
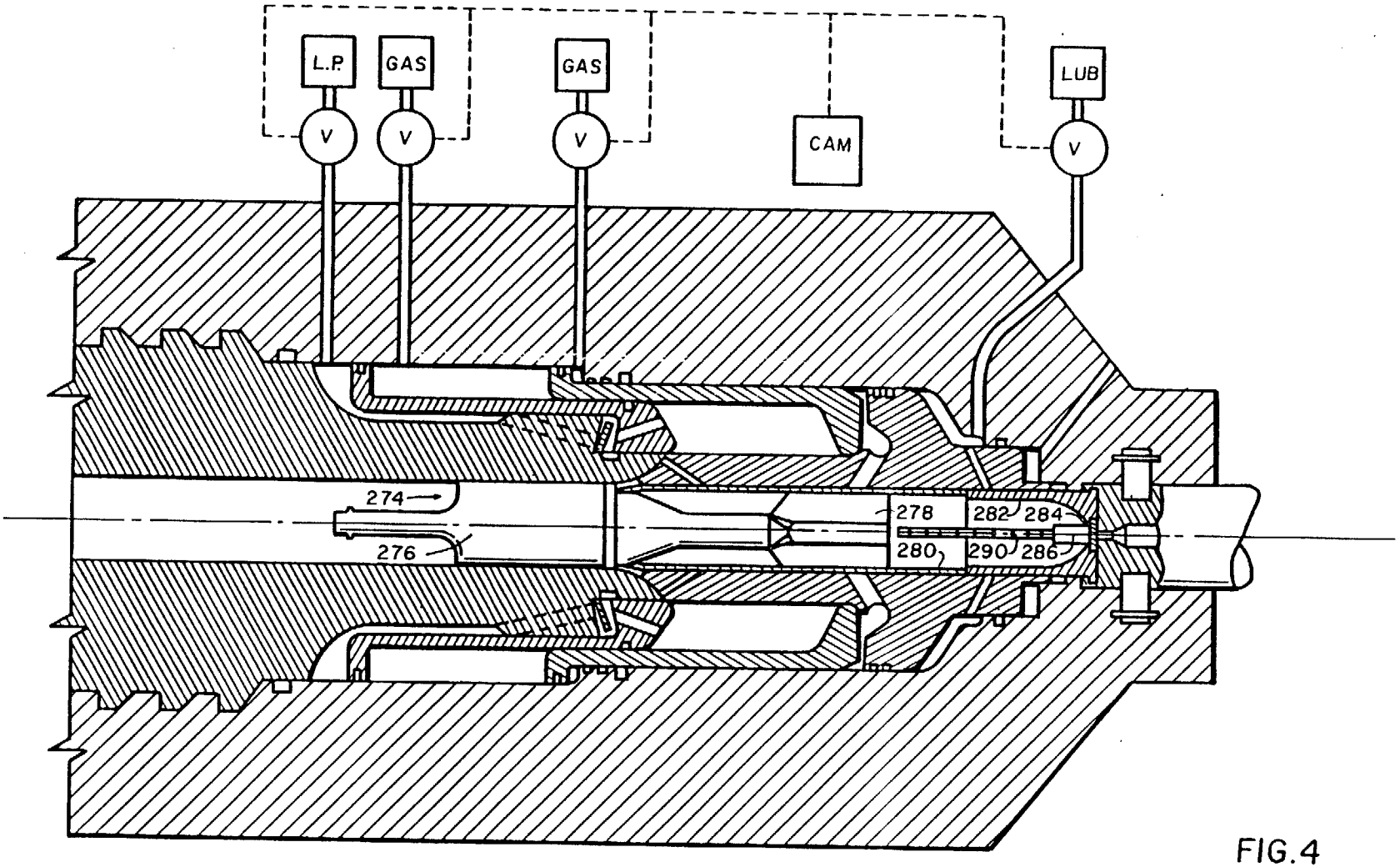
FIG. 4 is a view in elevation, in longitudinal cross section, similar to the first embodiment shown in FIG. 1, with a HEAT projectile with a stub case.

A High Explosive Anti Tank Projectile with a stub case is shown in FIG. 4. This projectile assembly 274 includes a HEAT warhead 276 with a tail stabilizer 278, a combustible case 280, a stub case 282 with an electric primer 284, a booster charge 286, and a flash tube 290 secured to the stub case. A gun bolt having a conventional electrical firing pin is shown in lieu of the gun bolt with a liquid propellant igniter. Lubricating fluid is provided to the interface of the short barrel with the stub case.

Each of these projectiles is intended to be fired from a smoothbore gun barrel. If a rifled gun barrel is used, then the projectiles will have rotating bands instead of gas obturators and will lack tail stabilizers. A projectile of this type is shown in U.S. Pat. No. 4,494,459, issued Jan. 22, 1985 to R. T. Ziemba.

Figure 1A:
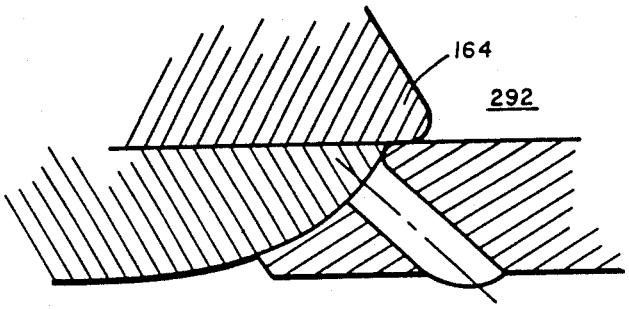
FIG. 1A is a detail of FIG. 1 showing the bore injector, which intercouples the pumping chamber with the combustion chamber, closed.
Figure 1B:
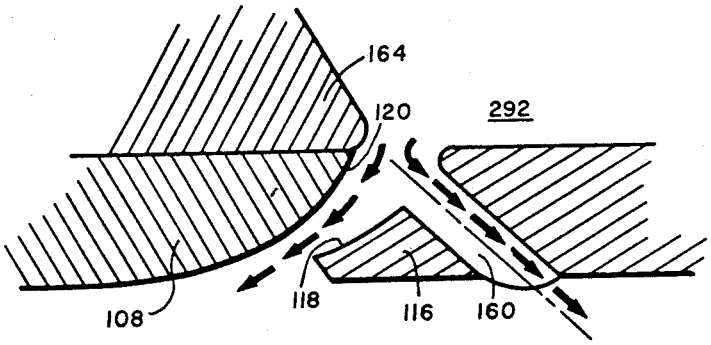
FIG. 1B is a detail of FIG. 1 showing the bore injector open.

The principles of operation of the gun may be reviewed by reference to FIGS. 1, 1A and 1B.

At the end of the previous operating cycle, the short barrel 116 was moved forward by the action of the valve 228 being opened and closed to admit a metered volume of lubricating fluid under pressure from the source 226 into the lubricant pumping chamber 140.

At the commencement of the operating cycle, the breech is open with the gun bolt withdrawn, the short barrel is forward, the fill valve is aft and the piston is forward. The interface of the surfaces 120 and 118 is closed and is overlaid by the nose of the aft head portion 164 of the fill valve.

A projectile is rammed, through the breech 106, until its obturator 242 is halted by the forcing cone 111 in the bore 110 of the main barrel 108.

The fill bias cavity 220 is pressurized by the valve 216 being opened and closed to admit a metered volume of gas under pressure from the gas source 215. This pressurized cavity biases the aft head portion 188 of the piston 186 against the aft head portion 164 of the fill valve 162 which in turn is biased against the belleville washer 176. The belleville washer is too stiff to be closed by this bias pressure.

The propellant reservoir cavity 200 is filled with liquid propellant under pressure from the source 194 by the valve 196 being opened and closed to admit a metered volume of liquid propellant through the passageway 198. The liquid propellant passes through the bores 182 in the annulus of the main barrel 108, passes around the belleville washer to open the valve 164, through the bores 165 in the head of the fill valve, and into a liquid propellant pumping chamber 292 defined between the respective heads 164 and 188 of the fill valve and the piston. The bias provided by the fill bias cavity 220 at all times minimizes the volume of the pumping chamber as it is enlarged from zero volume to maximum volume by the inleted liquid propellant to thereby preclude cavitation in the pumping chamber of entrapped gases.

The spring cavity 212 is pressurized by the valve 208 being opened and closed to admit a metered volume of gas under pressure from the gas source 206. The resulting compression spring serves to close the valve 164 against the belleville washer prior to firing and to damp the halt of the forward movement of the piston at the end of the pumping stroke.

Note that if it is desired to discontinue the operating cycle, the propellant can be down loaded by shifting the valve 208 to its vent outlet to vent the cavity 212, pressurizing the cavity 220 and shifting the valve 196 to its dump outlet.

The gun bolt 112 is inserted into the breech 106 and, as described in Ser. No. 263,792, its antechamber and inertial column with its terminal orifices all receive a charge of liquid propellant, the locks 114 are engaged to lock the bolt to the housing, and an electrical pulse, as from a charged capacitor, is applied across the two electrodes to ignite the liquid propellant in the antechamber, as a primer, which then ignites the liquid propellant in the inertial column, as a booster, to inject combustion gas from the igniter through the orifices into the main combustion chamber 156.

Combustion gas from the main combustion chamber flows through the bores 152 in the short barrel into the cavity defined between the head 188 of the piston and the flange 128 of the short barrel. This flow of gas forces the short barrel aftwardly, progressively closing the lubricant pumping chamber 140 to pump lubricant through (i) the passageways 138 to the interface of the short barrel and the gun bolt to provide an investment seal particularly residing in the grooves 148 and between the seals in grooves 146 and 148, and (ii) the passageway 230 through the valve 228 back to the lubricant source 226. This flow of gas also jogs the piston forwardly, and via the trapped liquid propellant in the pumping chamber 292, moves the fill valve further forward, against the belleville washer which closes the bores 182. As the short barrel moves progressively aftwardly, it progressively opens the interface 120/118 which, together with the bores 160, serves as an injection port or bore injector from the pumping chamber 292 into the combustion chamber 156. The annular, transverse, aft face of the head 188 of the piston has a relatively larger transverse area exposed to the combustion gas, while the annular, transverse, forward face of the head has a relatively smaller transverse area exposed to the liquid propellant in the pumping chamber. A regenerative action results with the forward face of the piston head progressively forcing liquid propellant into the combustion chamber to progressively generate combustion gas which is applied to the aft face of the piston head. The pressure of the combustion gas is also applied to the projectile to propel it forwardly along the longitudinal bore of the main barrel and out the muzzle of the gun which, of course, is the principal purpose of the total mechanism.

The progressive injection of a volume of propellant into the combustion chamber provides a pressure pulse which is longer in duration and lower in peak pressure than the pulse which would be provided by an equal volume of bulk loaded propellant, whether liquid or solid. The rate of opening of the injection port determines the shape and the magnitude of the curve of pressure versus time. The rate of opening is largely controlled by the hydraulic resistance placed on the rear face 134 of the short barrel annulus. The movement of the short barrel pumps lubricating fluid out of the lubricant pumping chamber through two routes as previously mentioned. In the first route, having a fixed hydraulic resistance, an investment seal for the breech/bolt interface is generated. In the second route, a selectable and variable resistance is provided by the cam controlled valve 228. If this valve is closed, then the short barrel, and thereby the enlargement of the injection port, can only move at the rate permitted by the fixed hydraulic resistance of the breech/bolt interface. This results in a slowly opening injection port or bore injector which is suitable for a heavyweight projectile. If this valve is open, then the short barrel, and the enlargement of the injection port, can open more rapidly, which is suitable for a lighter weight projectile. The effective orifice of this valve can be modulated by the cam, as shown in U.S. Pat. No. 3,763,739, to provide additional control over the opening of the injection port and thereby the shape of the pressure curve. The natural characteristics of this injection valving approach are well suited to the regenerative cycle. The initial rate of opening is slow, to aid in smooth ignition. The rate of opening increases as the combustion gas pressure increases and higher injection rates are needed to supply the rapidly expanding gas volume.

Figure 5:
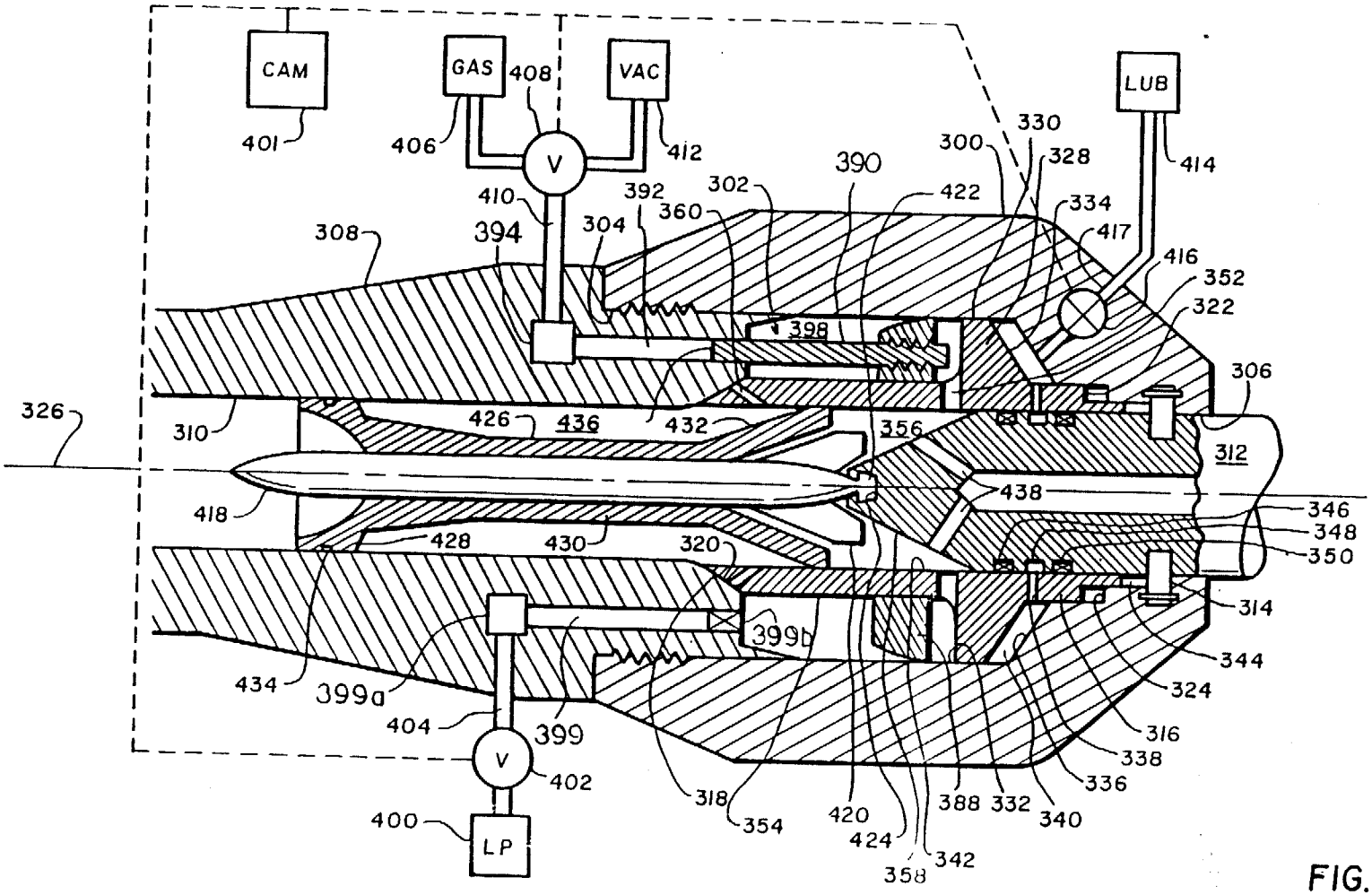
FIG. 5 is a view in elevation, in longitudinal cross section, of a second embodiment of this invention with a traveling charge APFSDS projectile with a hold-back link intercoupled to the gun bolt.

A second embodiment of this invention is shown in FIG. 5 as a Traveling Charge Gun. Traveling Charge Guns are discussed in U.S. patent application Ser. No. 150,351, filed Dec. 16, 1987 by M. J. Bulman, which issued Aug. 1, 1989 as U.S. Pat. No. 4,852,458, and which is hereby incorporated by reference. In such guns, the charge of liquid propellant is divided into two fractions: The first fraction is used to provide the projectile with an initial acceleration. The second fraction is used to provide the projectile with a traveling charge for subsequent acceleration.

A gun housing 300 has a central cavity 302 which has a forward opening 304, and an aft opening 306 serving as the breech. A main gun barrel 308 is secured into the forward opening 304 and has a longitudinal bore 310. A gun bolt 312 is reciprocable into and out of the aft opening 306 and is locked with conventional bolt locks 314. A short barrel 316 is disposed within the housing cavity 302 aft of the main barrel 308 and is reciprocable between a forward disposition whereat its conical-concave forward face 318 is flush against the conical-convex aft face 320 of the main barrel 308 and an aft disposition whereat its aft transverse face 322 is flush against the aft transverse face 324 of the housing cavity 302. The housing, the main barrel, the short barrel, and the gun bolt have a common longitudinal axis 326. The short barrel 316 has an annular flange 328 having an outer cylindrical surface 330 with annular seals which seal against an inner annular surface 332 of the housing cavity, and an aft transverse surface 334 which will mate with an inner surface 336 of the housing cavity. The short barrel 316 also has an aft plurality of bores 338 aft of the flange 328, disposed in an annular row, leading from the cavity 340, which serves as a lubricant pumping chamber and is defined by the surfaces 334 and 336, to the interface between the inner longitudinal bore 342 of the short barrel and the exterior cylindrical face 344 of the gun bolt 312. This exterior face 344 has a plurality of annular grooves 346, 348, and 350 therein with ring seals in groves 346 and 350. The short barrel 316 also has an intermediate plurality of bores 352, disposed in an annular row forward of the flange 328, leading from the exterior surface 354 of the short barrel, through the inner longitudinal wall of the bore 342, into the combustion chamber 356 which is defined by the short barrel bore 342 and the forward, hereshown as substantially conical, face 358 of the gun bolt. The short barrel 316 also has a forward plurality of bores 360 disposed in an annular row leading from the conical-concave forward face 318 through the inner longitudinal wall of the bore 342 to the combustion chamber 356. The short barrel longitudinal bore 342 has a diameter which is larger than the diameter of the main barrel bore 310.

The generally tubular fill valve shown in the first embodiment is replaced in this second embodiment by a number of discreet poppet valves leading to the liquid propellant chamber as will be described below.

A regenerative piston 386 has an aft annular head portion 388 to which is fixed a plurality of forwardly longitudinally extending rods 390 disposed in an annular row. The piston is telescopically disposed for fore and aft reciprocation with its head portion 388 telescopically disposed on and between the exterior cylindrical surface of the short barrel 316 and the inner surface 332 of the housing. The rods 390 are respectively disposed in a plurality of bores 392 disposed in an annular row extending forwardly from the aft transverse face of the main barrel to an annular manifold 394.

The liquid propellant pumping chamber 398 is defined by the forward transverse face of the piston head, the aft transverse face of the main barrel, the inner wall of the housing cavity, and the outer annular wall of the short barrel, less the volumes of the rods 390.

A plurality of bores 399 are disposed in an annular row, alternating with the bores 392, extending forwardly from the aft transverse face of the main barrel to an annular manifold **399*a*. A respective, spring loaded, normally closed, poppet valve 399*b* is fixed in the aft end of each of the bores 399. A source 400 of liquid propellant under pressure is coupled via a cam 401 controlled valve 402 and a passageway to the manifold 399*a***.

A source 406 of gas under pressure is coupled via a cam controlled two inlet valve 408 to a conduit which is coupled to the manifold 394. A source 412 of vacuum is also coupled to the valve 408. When initially the vacuum source 412 is coupled to the manifold 394, the bores 392 and the manifold 394 serve as a helical compression spring to minimize the possibility of cavitation of any entrapped gases. When, subsequently, the gas pressure source 406 is coupled to the manifold 394, the bores 392 and the manifold 394 serve as a helical compression spring to damp the halt of the forward movement of the piston at the end of the pumping stroke.

A source 414 of lubricating fluid is coupled via a cam controlled bidirectional, variable orifice, valve 416 to a passageway 417 through the housing which opens to the cavity 340 which serves as the lubricant pumping chamber. As in the first embodiment, this chamber provides a renewable investment seal, (and a fixed hydraulic resistance) to the gun bolt-breech interface, and a variable hydraulic resistance via the valve 416.

The gun bolt 312 and its gun bolt locks 314 are as described with respect to the first embodiment (and Bulman Ser. No. 263,792 and Tassie U.S. Pat. No. 3,772,959, supra, respectively.)

The projectile is a kinetic energy, subcaliber, saboted projectile assembly which may be of the type shown in U.S. patent application Ser. No. 255,065, filed Apr. 3, 1981 by M. J. Bulman (under Secrecy Order) which is hereby incorporated by reference. Briefly, the assembly includes a subcaliber projectile 418 having a tail stabilizer 420 and a hold-back link 422 interlocked with a recess 424 in the face of the gun bolt. The projectile is held in a segmented sabot 426 which has a forward portion 428 having a full bore diameter, an intermediate portion 430 having a reduced diameter, and an aft conical portion 432 having a resilient annulus of a full bore diameter. The forward portion has an obturating ring 43A. A travelling charge propellant reservoir 436 is defined by the forward, intermediate and aft portions of the sabot and the bore wall of the gun barrel.

At the commencement of the operating cycle, the breech is open with the gun bolt withdrawn, the short barrel is aft, and the piston is forward. The interface of the surfaces 320 and 318 is open.

The short barrel 316 is moved forward by the action of the valve 416 being opened and closed to admit a metered volume of lubricating fluid under pressure from the source 414 into the lubricating pumping chamber 340 to close the 318/320 interface.

A projectile assembly is rammed through the breech 306 and the short barrel 316 into the bore 310 of the main barrel 308. The length of the hold back-link 422 controls the longitudinal disposition of the projectile assembly. The rupture strength of the hold-back link controls the gas pressure of the shot start of the projectile assembly. As the projectile assembly is being rammed; (i) the valve 408 is opened and closed to the vacuum source 412 to develop a fill bias in the bores 392; (ii) the valve 402 is opened and closed to admit, against the fill bias, a metered volume of liquid propellant into the liquid propellant pumping chamber 398, progressively forcing the piston 386 aftwardly; (iii) the piston head portion 388 abuts the short barrel annular portion to jog the short barrel aftwardly to open the interface 318/320 to pass liquid propellant from the pumping chamber 398 into the traveling charge propellant reservoir 436. The gun bolt continues to ram the projectile assembly forward until the gun bolt is in its lock disposition and the bolt locks 314 can be engaged. The loading of the traveling charge is completed before the gun bolt is locked, and the valve 408 is opened and closed to the gas source 406 to admit a metered volume of gas into the cavity 392 to serve as the piston damping spring. As the bolt approaches its locking disposition, its anterior chamber and conduit are charged with liquid propellant as described in Bulman, Ser. No. 263,792, supra, and when the bolt is locked, the voltage pulse is applied to the electrodes and ignition starts.

The conduit discharges combustion gas under pressure through the ignitor orifice, (here shown as two diverging orifices 438) into the combustion chamber 356 (forward of the gun bolt and aft of the sabot aft portion 432,) and thence through the bores 352 which drives the piston 386 forwardly and the short barrel aftwardly. Forward movement of the piston increases, via the interface 318/320, the pressure in the traveling charge reservoir 436, to deflect inwardly the outer annulus of the sabot aft portion 432, to provide a gap with the short barrel bore wall, through which liquid propellant flows into the combustion chamber. When the gas pressure in the combustion chamber develops a force on the effective transverse aft surface of the projectile assembly which exceeds the rupture strength of the hold-back link, the link ruptures to release the projectile assembly from the gun bolt, and the projectile assembly starts to accelerate forwardly along the gun barrel bore. When the outer annulus of the sabot aft portion 432 departs the (enlarged diameter) bore 342 of the short barrel and enters the (reduced diameter) bore 310 of the main barrel, it reseals against the reduced diameter bore 310.

Injection of liquid propellant from the pumping chamber 398 through the increasingly opening interface 318/320 is now controlled by the aftward movement of the short barrel. This aftward movement is controlled by the hydraulic resistance to the pumping of lubricating fluid out of the lubricant pumping chamber 340 as described with respect to the first embodiment.

As described in Bulman, Ser. No. 255,065, supra, the discharge, ignition and combustion of the traveling charge from the reservoir 436 is delayed until the projectile assembly has traveled forwardly a significant distance along the main barrel bore.

What is claimed is:

1. A gun for combusting liquid propellant for generating gas for firing a projectile, comprising:
- an assembly including a housing and a main gun barrel;
- a combustion chamber disposed within said assembly;
- a liquid propellant pumping chamber disposed within said assembly; and
- valve means, for providing a variable orifice injection port intercoupling said pumping chamber and said combustion chamber, including
  - means for controlling the rate of opening of the orifice of said injection port over the period of time of the injection of liquid propellant through said port,
  - said controlling means is a slide means which opens said orifice in response to force generated by the pressure of combustion gas in the combustion chamber,
  - said slide means in responding to said force is resisted by a hydraulic dash pot means,
  - said hydraulic dash pot means has
    - a constant hydraulic resistance means, and
    - a selectively variable hydraulic resistance means,
  - said selective variable hydraulic resistance means includes means for varying the resistance during said period of injection,
  - said means for varying the resistance includes a valve having an orifice which is variable in response to a cam which is coupled to said valve.

2. A gun for combusting liquid propellant for generating gas for firing a projectile, comprising:
- an assembly including a housing and a main gun barrel;
- a breech in said housing;
- a gun bolt disposed in said breech;
- a combustion chamber disposed within said assembly;
- a liquid propellant pumping chamber disposed within said assembly; and
- valve means, for providing a variable orifice injection port intercoupling said pumping chamber and said combustion chamber, including
  - means for controlling the rate of opening of the orifice of said injection port over the period of time of the injection of liquid propellant through said port,
  - said controlling means is a slide means which opens said orifice in response to force generated by the pressure of combustion gas in the combustion chamber,
  - said slide means in responding to said force is resisted by a hydraulic dash pot means,
  - said hydraulic dash pot means has
    - a constant hydraulic resistance means, and
    - a selectively variable hydraulic resistance means
  - said constant hydraulic resistance means includes
    - a lubricating fluid pumping chamber having a piston coupled to said slide means and an outlet coupled to the interface between said gun bolt and breech for pumping said fluid into said interface.

3. A gun for combusting liquid propellant for generating gas for firing a projectile, comprising;
- an assembly including a housing and a main gun barrel;
- a combustion chamber disposed within said assembly;
- a liquid propellant pumping chamber disposed within said assembly; and
- valve means, for providing a variable orifice injection port intercoupling said pumping chamber and said combustion chamber, including
  - means for controlling the rate of opening of the orifice of said injection port over the period of time of the injection of liquid propellant through said port, said controlling means is a slide means which opens said orifice in response to force generated by the pressure of combustion gas in the combustion chamber.

said slide means in responding to said force is resisted by a hydraulic dash pot means.

said hydraulic dash pot means has a constant hydraulic resistance means, and a selectively variable hydraulic resistance means.

said selectively variable hydraulic resistance means includes a lubricating fluid pumping chamber having a piston coupled to said slide means and an outlet coupled to a valve having an orifice which is variable in response to a cam which is coupled to said valve.

4. A gun for combusting liquid propellant for generating gas for firing a projectile, comprising:

an assembly including a housing and a main gun barrel;

a breech in said housing;

a gun bolt disposed in said breech;

a combustion chamber disposed within said assembly;

a liquid propellant pumping chamber disposed within said assembly; and valve means, for providing a variable orifice injection port intercoupling said pumping chamber and said combustion chamber, including means for controlling the rate of opening of the orifice of said injection port over the period of time of the injection of liquid propellant through said port;

said controlling means is a slide means which opens said orifice in response to force generated by the pressure of combustion gas in the combustion chamber;

said slide means in responding to said force is resisted by a hydraulic dash pot means;

said hydraulic dash pot means has a constant hydraulic resistance means, and a selectively variable hydraulic resistance means;

said main gun barrel, said combustion chamber, said liquid propellant pumping chamber, said orifice, said slide means, and said gun bolt are all coaxial; and a projectile is disposed at least in part within said main gun barrel forward of said combustion chamber and is coupled to a cartridge case means which includes a primer; and said gun bolt includes means for detonating said primer.

5. A gun for combusting liquid propellant for generating gas for firing a projectile, comprising:

an assembly including a housing and a main gun barrel;

a breech in said housing;

a gun bolt disposed in said breech;

a combustion chamber disposed within said assembly;

a liquid propellant pumping chamber disposed within said assembly; and valve means, for providing a variable orifice injection port intercoupling said pumping chamber and said combustion chamber, including means for controlling the rate of opening of the orifice of said injection port over the period of time of the injection of liquid propellant through said port;

said controlling means is a slide means which opens said orifice in response to force generated by the pressure of combustion gas in the combustion chamber;

said slide means in responding to said force is resisted by a hydraulic dash pot means;

said main gun barrel, said combustion chamber, said liquid propellant pumping chamber, said orifice, said slide means, and said gun bolt are all coaxial; and a projectile is disposed at least in part within said main gun barrel forward of said combustion chamber and includes a reservoir for receiving liquid propellant from said liquid propellant pumping chamber.

6. A gun for combusting liquid propellant for generating gas for firing a projectile, comprising:

a housing having an aft breech;

a gun bolt for obturating said breech;

a main gun barrel fixed to said housing and having a longitudinal firing bore;

valve means disposed in said housing aft of said main gun barrel and forward of said housing and having a longitudinal bore;

said housing breech, said main barrel bore and said valve means bore being coaxial and jointly providing a rectilinear passageway for a projectile through said breech to the muzzle of said main barrel;

a combustion chamber disposed within said assembly;

a liquid propellant pumping chamber disposed within said assembly;

said valve means providing a variable orifice injection port intercoupling said pumping chamber and said combustion chamber, and including:

means for controlling the rate of opening of the orifice of said injection port over the period of time of the injection of liquid propellant through said port.

7. A gun according to claim 6, wherein:

said controlling means is a slide means which opens said orifice in response to force generated by the pressure of combustion gas in the combustion chamber.

8. A gun according to claim 7, wherein:

said slide means in responding to said force is resisted by a hydraulic dash pot means.

9. A gun according to claim 8;

a gun bolt disposed in said breech;

said main gun barrel, said combustion chamber, said liquid propellant pumping chamber, said orifice, said slide means, and said gun bolt are all coaxial; and a projectile is disposed at least in part within said main gun barrel forward of said combustion chamber and includes a reservoir for receiving liquid propellant from said liquid propellant pumping chamber.

10. A gun according to claim 8, wherein:

said hydraulic dash pot means has a constant hydraulic resistance means, and a selectively variable hydraulic resistance means.

11. A gun according to claim 10, wherein said constant hydraulic resistance means includes a lubricating fluid pumping chamber having a piston coupled to said slide means and an outlet coupled to the interface between said gun bolt and breech for pumping said fluid into said interface.

12. A gun according to claim 10, wherein:

said selectively variable hydraulic resistance means includes a lubricating fluid pumping chamber having a piston coupled to said slide means and an outlet coupled to a valve having an orifice which is variable in response to a cam which is coupled to said valve.

13. A gun according to claim 10, wherein:

said selectively variable hydraulic resistance means includes means for varying the resistance during said period of injection.

14. A gun according to claim 13, wherein:

said means for varying the resistance includes a valve having an orifice which is variable in response to a cam which is coupled to said valve.

15. A gun according to claim 10, said main gun barrel, said combustion chamber, said liquid propellant pumping chamber, said orifice, said slide means, and said gun bolt are all coaxial; and a projectile is disposed at least in part within said main gun barrel forward of said combustion chamber.

16. A gun according to claim 15 wherein:

said gun bolt includes a combustion chamber for receiving a volume of liquid propellant and an ignitor for igniting a received volume of liquid propellant.

17. A gun according to claim 15 wherein:

said projectile is coupled to a cartridge case means which includes a primer; and said gun bolt includes means for detonating said primer

* * * * *

UNITED STATES PATENT AND TRADEMARK OFFICE

CERTIFICATE OF CORRECTION

PATENT NO. : 4,934,242

DATED : June 19, 1990

INVENTOR(S) : Melvin J. Bulman

It is certified that error appears in the above-identified patent and that said Letters Patent is hereby corrected as shown below:

FIGURES 2, 3, 4 and 5 of the Drawing should appear as shown on the attached sheets.

Title Page: "17 claims, 2 Drawings Sheets" should read --17 claims 6 Drawings Sheets--.

Signed and Sealed this

Twenty-eighth Day of April, 1992

*Attest:*

HARRY F. MANBECK, JR.

*Attesting Officer*

*Commissioner of Patents and Trademarks*